US005392570A

United States Patent [19]

Cowan

[11] Patent Number: 5,392,570

[45] Date of Patent: Feb. 28, 1995

[54] SECURITY BAR ASSEMBLY

[76] Inventor: M. A. Cowan, 2615 E. North Ave., Anderson, S.C. 29625

[21] Appl. No.: 194,834

[22] Filed: Feb. 14, 1994

[51] Int. Cl.[6] ..... E04H 3/08

[52] U.S. Cl. ..... 52/106; 52/507; 49/50

[58] Field of Search ..... 52/664, 669, 106, 204.61, 52/507; 49/50, 57, 61

[56] References Cited

U.S. PATENT DOCUMENTS 973,733 10/1910 Wilson .
1,634,843 7/1927 McWane .
4,669,239 6/1987 Maggs et al. ..... 52/106
5,269,096 12/1993 Hade ..... 49/57
5,313,748 5/1994 Hughes, Jr. ..... 52/106 X

*Primary Examiner*—Carl D. Friedman
*Assistant Examiner*—Creighton Smith
*Attorney, Agent, or Firm*—Cort Flint; Gerald R. Boss

[57] ABSTRACT

A security bar assembly for an entrance to a building to prevent the entrance of intruders while enabling individuals to exit the building includes a plurality of security bars, a first and second mounting bracket, an interlocking member slidably mounted in relationship to the first mounting bracket.

12 Claims, 6 Drawing Sheets

SECURITY BAR ASSEMBLY

BACKGROUND OF THE INVENTION

This invention relates to a security system in general, and in particular to a security bar assembly having detachable security bars for an entrance of a building to prevent the entrance of intruders while enabling the exit of individuals from within the building.

The presence of crime in society, especially the breaking and entering into domestic dwellings and businesses, has prompted action to be taken in the establishment of security means in which to protect these buildings. It is common, for instance, for the placement of wrought iron bars to be welded on the outside of windows, or attachment of wrought iron gates on the outside of windows and doors. Such security measures pose a threat to the occupants of such dwellings for should the need arise in an emergency situation, for example, in a fire, the dwelling's occupants only means of escape may be through a window or other entrance way which is blocked by the wrought iron fixture outside of the window. Accordingly, the occupants would find themselves trapped with no means of exiting the building.

Accordingly, it is desirable that a security system for occupied dwellings consists of a means for the removing of the security means in case of emergencies. Such a system would require the removability of the entire system or bars and, for practical purposes, would be located in the interior of the building. U.S. Pat. No. 973,733 discloses a window guard having pivoting bars engaging cross rods. Such a configuration may be complicated to use in an emergency situation and has disadvantages. For instance, the occupant will need to reach to the top of the window guard, unlock the pivoting arms, and pivot the arms to remove the bars. These steps would take a sufficient amount of time. Additionally a small individual may lack sufficient height in which to unlock the pivoting bars. U.S. Pat. No. 1,634,843 illustrates a window guard having a plurality bar and mounting element in addition to a locking device. The bars each have holes in which to receive a down turned angle lock pin. Such a configuration is awkward in that the user must accurately align the holes of the bars with the particular lock. Additionally, this guard does not prevent entry through the window should anyone on the outside of the window break the glass.

Accordingly, it is an object of the present invention to provide a security bar assembly which provides for the removal of the bar by an occupant of the dwelling to enable the occupant to exit through an entrance or a window;

Furthermore, it is an object of the present invention to provide a security bar assembly having rods for barricading an entrance way and which can be assembled and disassembled easily;

Additionally, it is an object of the present invention to have a security bar assembly having an interlocking member which is easy to operate should an emergency exist and time is of the essence;

Additionally, it is an object of the present invention to use gravity to assist in unlocking the security bars from the security bar assembly when time is of an essence in an emergency.

SUMMARY OF THE INVENTION

The above objectives are accomplished according to the invention by providing a security bar assembly for an entrance of a building to prevent the entrance of intruders into the building while enabling individuals to exit the building. The security bar assembly includes a plurality of security bars, a first and second mounting member, and an interlocking member slidably mounted in relationship with the first mounting member. The plurality of security bars traverse and barricade the entrance. The first mounting member includes a plurality of first spaced apertures which receive a first end of the security bar. The interlocking member includes a plurality of second spaced apertures which correspond with the plurality of first spaced apertures. Accordingly, the interlocking member is moveable to a bar receiving position whereby the first and second plurality of spaced apertures are in alignment enabling the first end of the plurality of security bars to be inserted through the first and second plurality of spaced apertures. The second mounting member includes a plurality of third spaced apertures which also correspond with the plurality of first spaced apertures for receiving the second end of the security bars. Accordingly, with the first and second ends of the plurality of the security bars mounted, the security bars barricade the entrance. The interlocking member is also moveable to a bar locking position so that the first and second plurality of spaced apertures are unaligned preventing the first end of the security bar entering the second apertures thereby retaining the security bars within the first and second mounting members. Accordingly, with the interlocking member in a bar locking position, the security bars are locked into a position between the first and second mounting members and across the entrance.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail.

Figure 1:
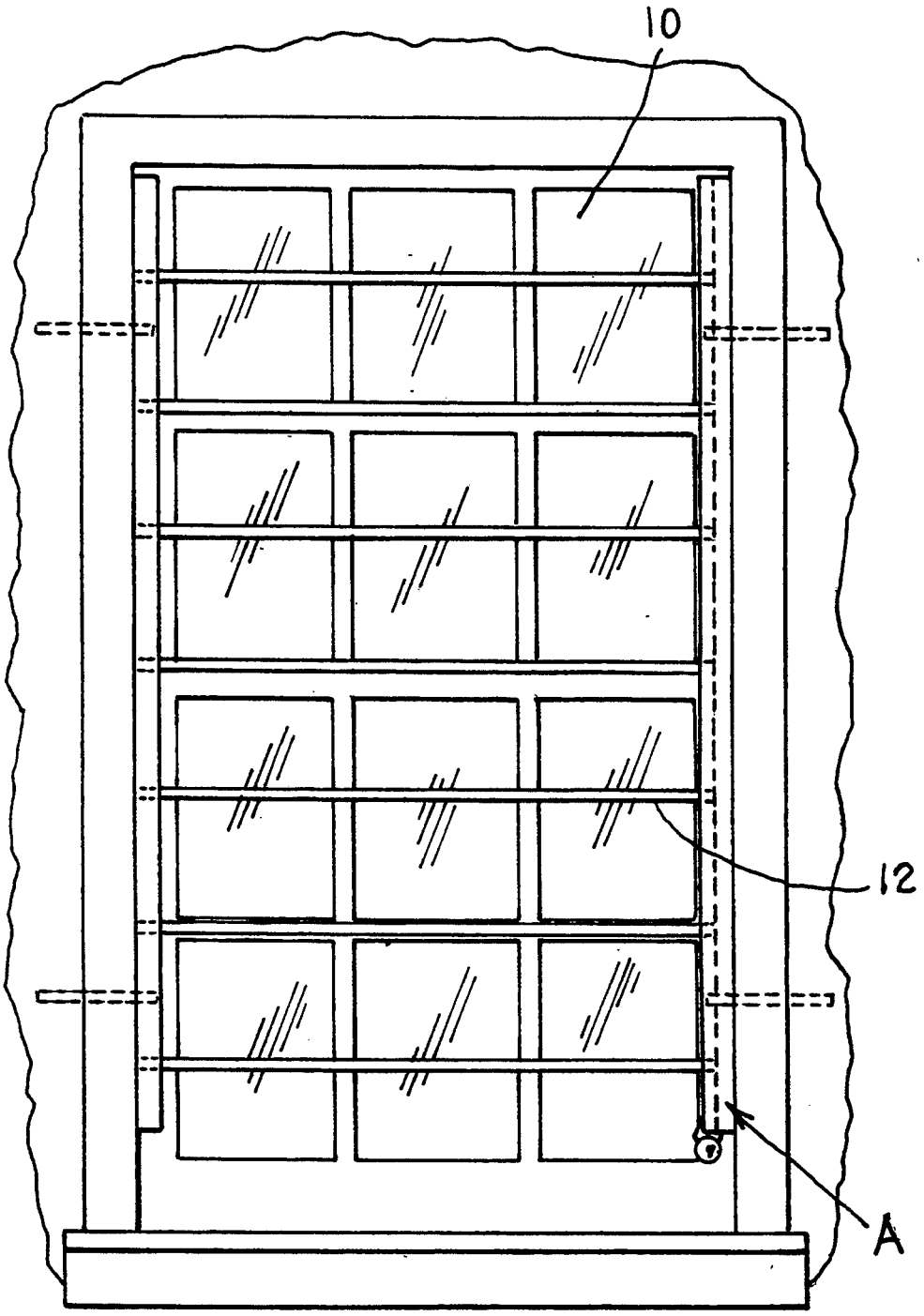
FIG. 1 shows the security bar assembly mounted within a window unit.
Figure 2:
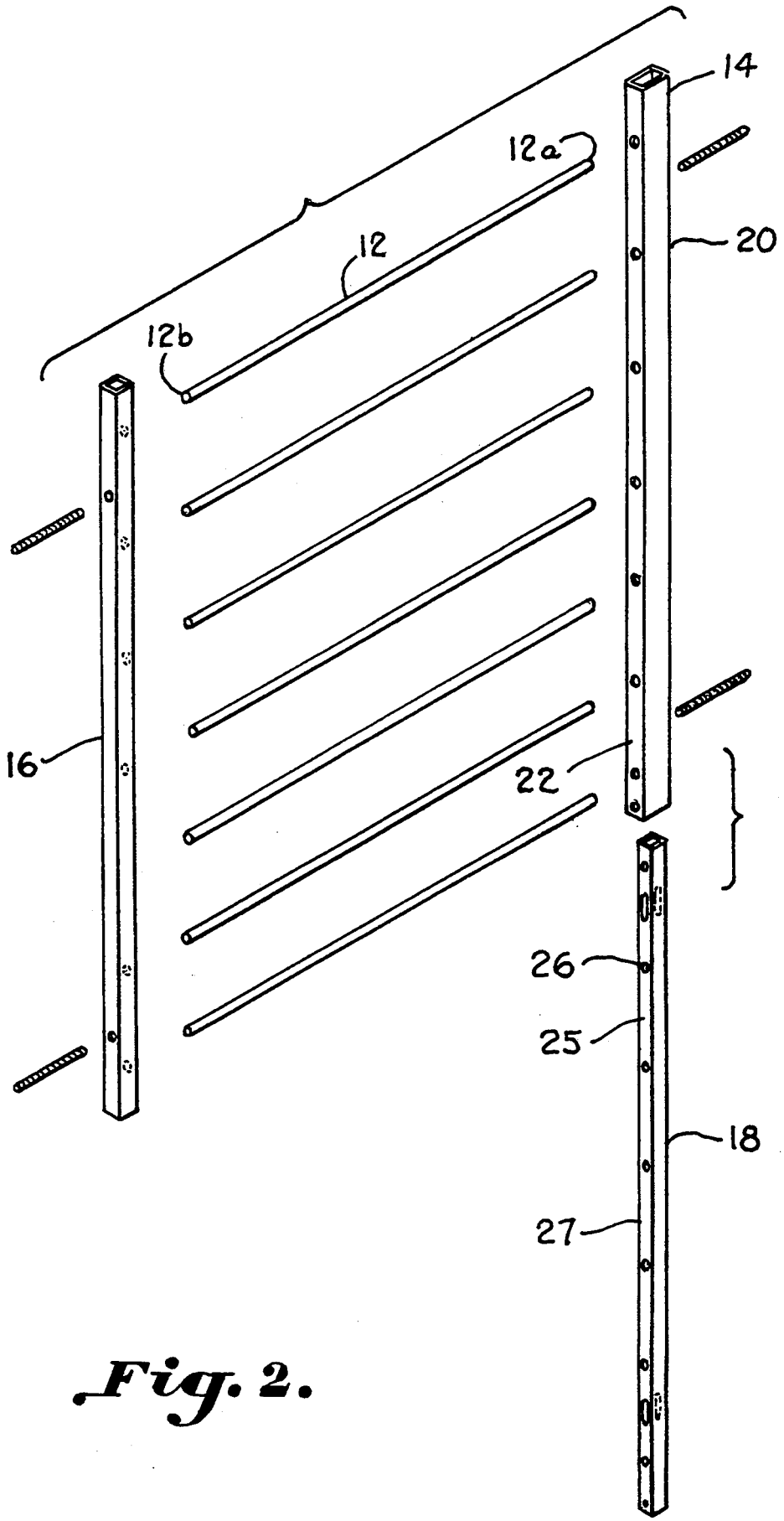
FIG. 2 shows an exploded view of the invention.
Figure 3:
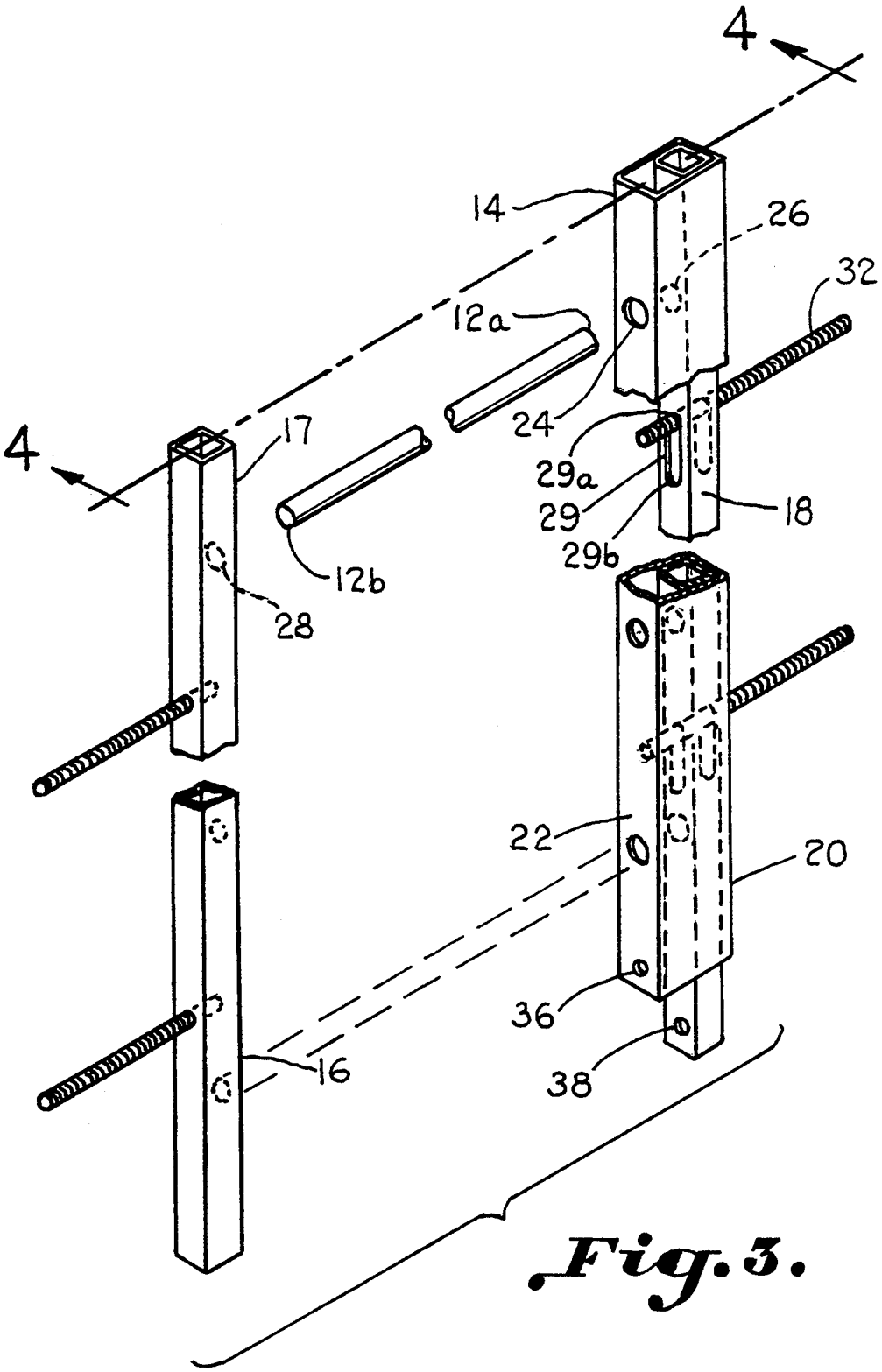
FIG. 3 illustrates the locking member of the invention in a bar receiving position.
Figure 4:
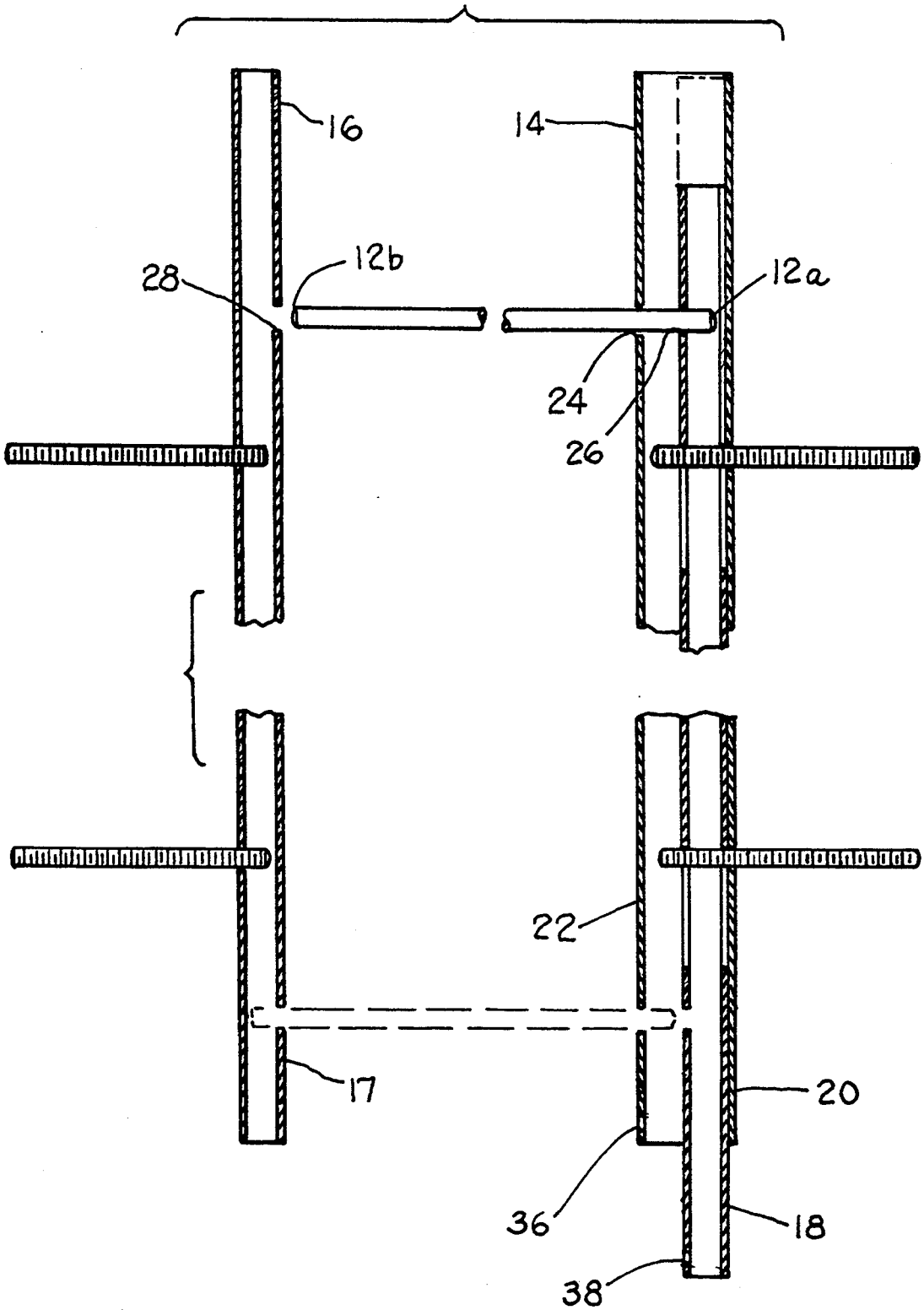
FIG. 4 is a cross section of FIG. 3 along lines 4—4 of FIG. 3.

As shown in FIG. 1, a security bar assembly A is shown mounted within an entrance 10. The entrance could either be a window or a door. In the preferred embodiment where the entrance is a window, security bar A is mounted within the frame work of the window. Shown in FIGS. 1 and 2 security bar assembly A is comprised of a plurality of security bars 12 having a first end 12*a* and second end 12*b* which traverse entrance 10 for barricading the entrance. In the preferred embodiment security bars 12 traverse laterally across entrance 10 to present an appearance conforming to window panes. A first mounting bracket 14 and a second mounting bracket 16 support security bars 12 across entrance 10. As shown in FIGS. 3 and 4, interlocking member 18 is disposed in a slidable relationship with first mounting bracket 14 for locking plurality of security bars 12 in place.

First mounting bracket 14 has a mounting face 20 and a bar receiving face 22. Bar receiving face 22 has a plurality of first spaced apertures 24 which define passages corresponding with the number of security bars 12 which comprise security bar assembly A. Interlocking member 18 has a locking face 25 which has a plurality of second spaced apertures 26 which define passages and are spaced apart an equivalent distance corresponding with the spacing of first spaced apertures 24. Locking surfaces 27 are intermediary second spaced apertures 26 which prevent movement of security bars 12 when in a locking position.

Figure 5:
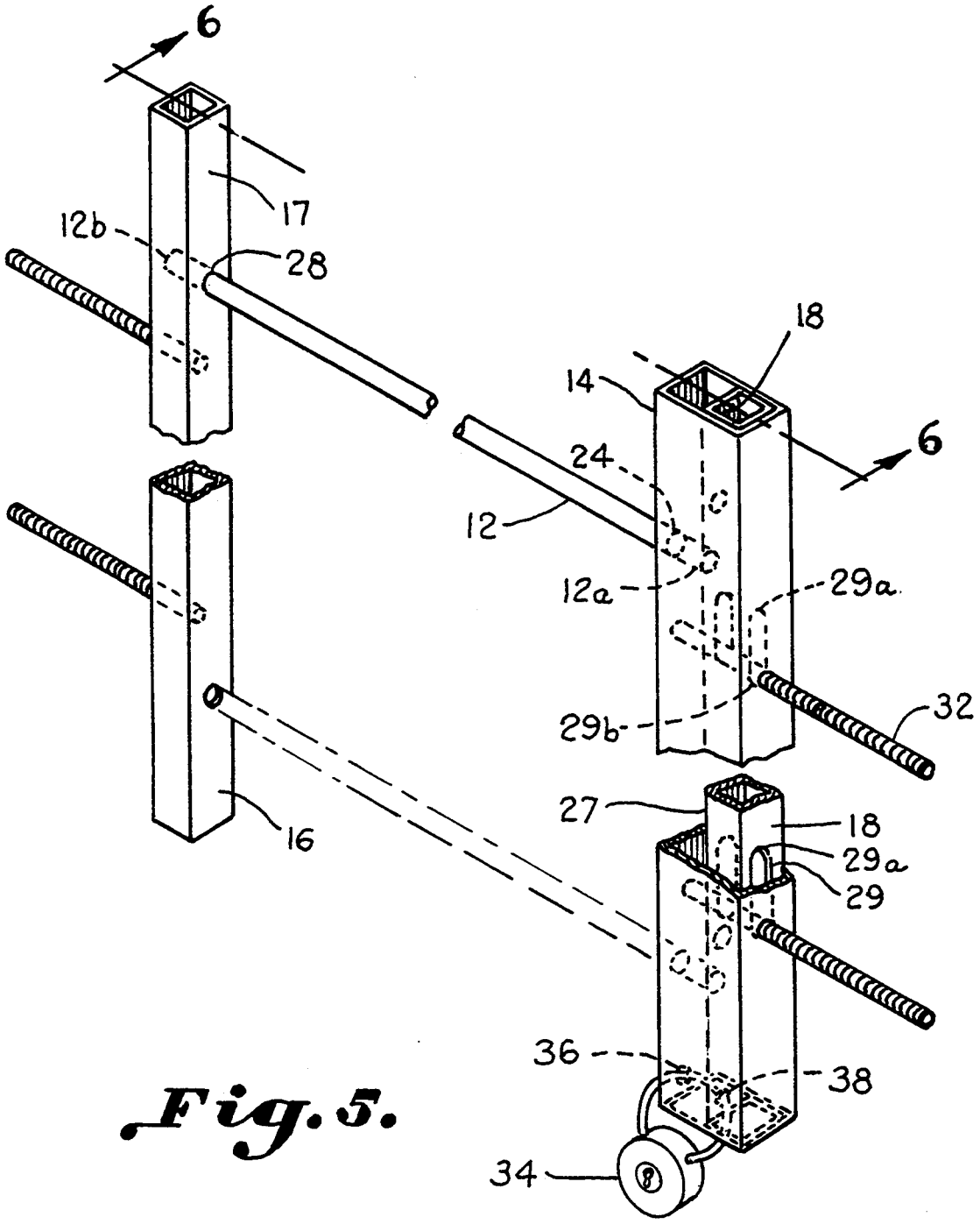
FIG. 5 illustrates the interlocking member in a bar locking position.

As shown in FIGS. 4 and 5, second mounting bracket 16 has a bar receiving face 17. Bar receiving face 17 has a plurality of third spaced apertures 28 defining passages which are spaced apart correspondingly to the spacing of the plurality of first spaced apertures 24. First and third apertures 24 and 28 oppose each other when first and second mounting brackets are mounted. Accordingly, the second end of security bars 12*b* can be received within the plurality of third spaced apertures 28 when first ends of security bar A are positioned within first and second spaced apertures.

In the preferred embodiment mounting brackets 14 and 16 and interlocking member 18 are elongated tubular members. As shown in FIGS. 3 and 4, interlocking member 18 is received within the interior of first mounting bracket 14. Interlocking member 18 includes a first mounting slot 29 of a predetermined length having a first stopping end 29*a* and a second stopping end 29*b* for slidably mounting locking member 18 within first hollow mounting bracket 14. First hollow mounting bracket 14 includes a mounting opening 30 which receives a mounting bolt 32 thereby providing a tab for supporting interlocking member 18. In the preferred embodiment, two mounting bolts support mounting brackets 14 and 16. Interlocking member 18 is suspended by bolt 32 at first stopping end 29*a* of first mounting slot 29. In this suspended state, the plurality of first and second spaced apertures align providing for the receipt of security bars 12 through the plurality of first and second spaced apertures. This alignment is referred to as the bar receiving position.

Security bars 12 are of a width greater than the distance separating first and second mounting brackets. Accordingly, security bars 12 cannot be inserted directly into the plurality of first and third spaced apertures. To insert security bars 12 within security bar assembly A, first end 12*a* must first be inserted through first and second spaced apertures thereby enabling second end 12*b* of security bar 12 to be aligned with third aperture 28 of second mounting bracket 16. After security bars 12 are aligned with plurality third spaced apertures 28, second end 12*b* is inserted into plurality of third spaced apertures thereby removing first end 12*a* from plurality of second spaced apertures 26 while still maintaining first end 12*a* within the interior of first mounting bracket 14.

Figure 6:
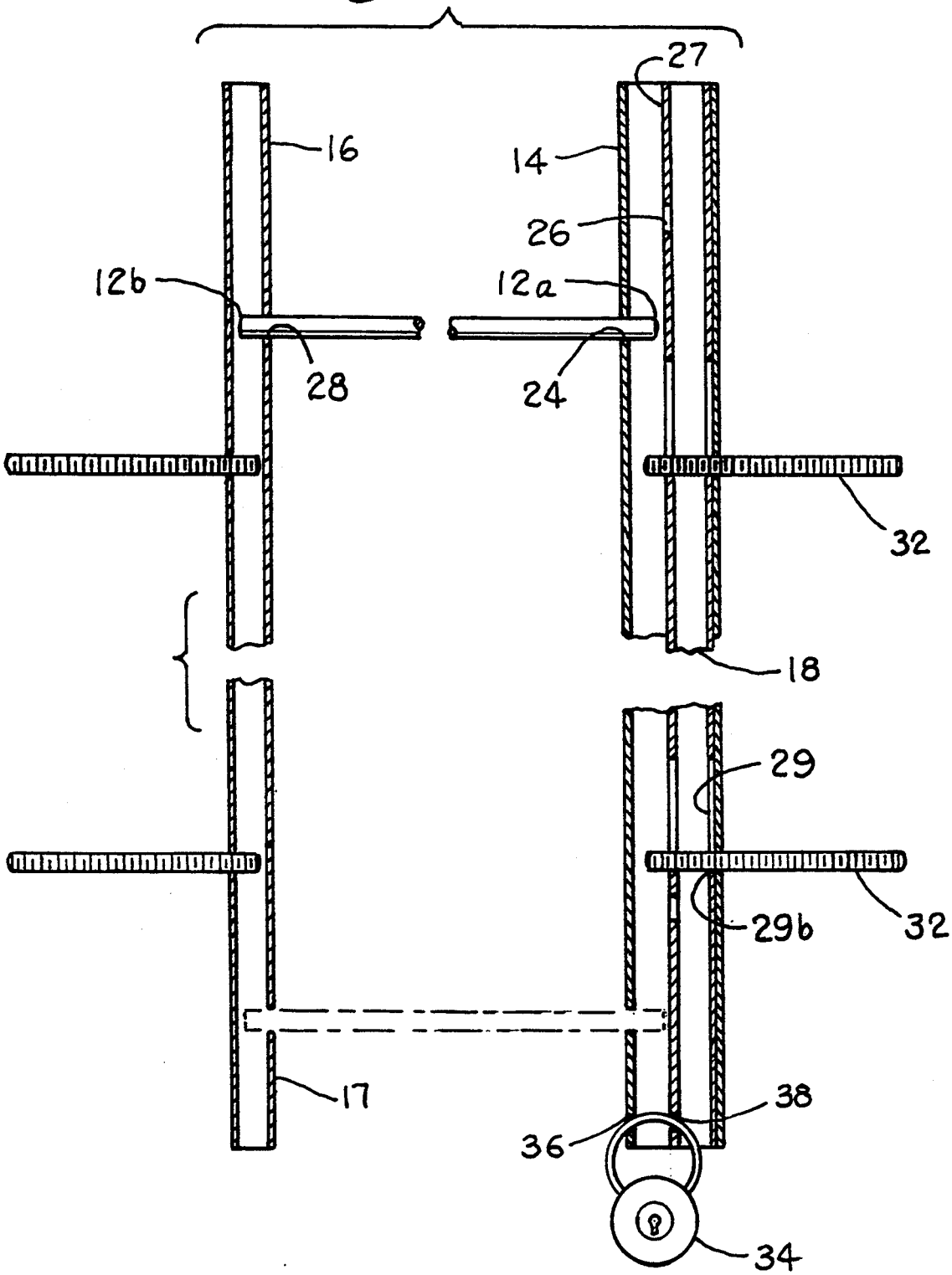
FIG. 6 is a cross section taken along lines 6—6 of FIG. 5.

As shown in FIGS. 5 and 6 after first end of security bar 12*a* has been removed from plurality of second spaced aperture 26, interlocking member 18 is moved upward thereby unaligning the first and second pluralities of spaced apertures and abutting locking surface 27 with first end 12*a*. The second end 29*b* of first mounting slot 29 engages bolt 32 placing interlocking member 18 in a position whereby first and second apertures unalign and prevents second end 12*b* from exiting third space apertures 28. This position is referred to as the bar locking position. As shown in FIGS. 5 and 6 a locking means locks the interlocking member into said bar locking position. In a preferred embodiment, locking means 34 is a simple padlock which passes through locking apertures 36 and 38 located in first mounting bracket 14 and interlocking member 18 respectively.

When interlocking member 18 is slid upward into the bar locking position, security bar 12 cannot be removed from security bar assembly A because the width of security bar 12 is greater than the distance separating first mounting bracket 14 and second mounting bracket 16. In the bar locking position, first end 12*a* of security bar 12 abuts locking surface 27 locking security bar 12 in place. Locking means 34 supports interlocking member 18 in the bar locking position. Accordingly, interlocking member 18 will maintain the bar locking position until it is no longer supported by interlocking means 34.

When interlocking means 34 is removed from security bar assembly A, gravity will pull interlocking member 18 downward until first stopping end 29*a* of first mounting slot 29 engages mounting bolt 32 arresting the descent of interlocking member 18. Consequently, the gravitational pull on unsupported interlocking member 18 automatically aligns the pluralities of first and second spaced apertures 24 and 26 providing sufficient horizontal space for the removal of end 12*b* of security bar 12 from third apertures 28. With the removal of end 12*b* from third apertures 28, end 12*a* may then be easily removed from first mounting bracket 14. Accordingly, once all security bars are removed, the window is no longer secured and the occupant may exit through the window.

While a preferred embodiment of the invention has been described using specific terms, such description is for illustrative purposes only, and it is to be understood that changes and variations may be made without departing from the spirit or scope of the following claims.

What is claimed is:

1. A security bar assembly for an entrance of a building to prevent the entrance of intruders while enabling the exit of individuals within the building, said security bar assembly comprising:

a plurality of security bars traversing said entrance for barricading said entrance, and said security bars having a first end and a second end;

a first hollow mounting bracket having a mounting face and a bar receiving face, said bar receiving face having a plurality of first spaced apertures for receiving said first ends of said security bars;

an interlocking member slidably mounted within said hollow interior of said first mounting bracket having a plurality of second spaced apertures corresponding with said first spaced apertures for receiving said first ends of said security bars;

a second mounting bracket having a plurality of third spaced apertures corresponding with said first spaced apertures for receiving said second ends of said security bars;

said interlocking member moveable to a bar receiving position whereby said first and second spaced apertures align and said interlocking member being moveable to a bar locking position so that said first and second spaced apertures are unaligned preventing said first ends from entering said second spaced apertures;

whereby security bars are locked into a position between first and second mounting brackets barricading an entrance.

2. The security bar assembly of claim 1 wherein said first hollow mounting bracket includes a tab for supporting said interlocking member.

3. The security bar assembly of claim 2 wherein said interlocking member includes a mounting slot of a predetermined length having a first stopping end and a second stopping end.

4. The security bar assembly of claim 3 wherein said tab engages said first stopping end of said mounting slot suspending said interlocking member at said bar receiving position.

5. The security bar assembly of claim 3 wherein said tab engages said second stopping end of said mounting slot placing said interlocking member at said bar locking position.

6. The security bar assembly of claim 5 including a locking means for maintaining said interlocking member at said bar locking position.

7. The security bar assembly of claim 1 wherein said security bars transverse laterally across said entrance.

8. The security bar assembly of claim 1 wherein said first and second mounting brackets include elongated tubular members having hollow interiors and opposing bar receiving faces when mounted in said entrance, and said first and third spaced apertures are formed in said opposing faces.

9. The security bar assembly of claim 8 wherein said interlocking member includes a third elongated tubular member slidably received inside said first tubular member, and said third elongated tubular member includes a locking face in which said second spaced apertures are found, and includes solid locking surfaces which prevent movement in said locking position.

10. A security bar assembly for an entrance of a building to prevent the entrance of intruders while enabling the exit of individuals within the building, said security bar assembly comprising:

a plurality of security bars traversing said entrance for barricading said entrance, and said security bars having a first end and a second end;

a first mounting bracket having a mounting face and a bar receiving face, said bar receiving face having a plurality of first spaced passages for receiving said first ends of said security bars;

an interlocking member disposed in a slidable relationship with said first mounting bracket having a plurality of second spaced passages corresponding with said first spaced passages for receiving said first ends of said security bars;

a second mounting bracket having a plurality of third spaced passages corresponding with said first spaced passages for receiving said second ends of said security bars;

said interlocking member moveable to a bar receiving position whereby said first and second spaced passages align and said interlocking member being moveable to a bar locking position so that said first and second spaced passages are unaligned preventing said first ends from entering said second spaced passages;

whereby security bars are locked into a position between first and second mounting brackets barricading an entrance.

11. The security bar assembly of claim 10 including a locking means for maintaining said interlocking member at said bar locking position.

12. The security bar assembly of claim 10 wherein said security bars transverse laterally across said entrance.

* * * * *